US007121237B2

(12) United States Patent
Hedman

(10) Patent No.: US 7,121,237 B2
(45) Date of Patent: Oct. 17, 2006

(54) DEVICE AND A METHOD FOR THE GENERATION OF PRESSURE PULSES

(75) Inventor: Mats Hedman, Bàvensvik (SE)

(73) Assignee: Cargine Engineering AB, Helsingborg (SE)

( * ) Notice: Subject to any disclaimer, the term of this patent is extended or adjusted under 35 U.S.C. 154(b) by 0 days.

(21) Appl. No.: 10/515,925

(22) PCT Filed: May 23, 2003

(86) PCT No.: PCT/SE03/00837

§ 371 (c)(1),
(2), (4) Date: Jul. 19, 2005

(87) PCT Pub. No.: WO03/102386

PCT Pub. Date: Dec. 11, 2003

(65) Prior Publication Data

US 2005/0263117 A1 Dec. 1, 2005

(30) Foreign Application Priority Data

May 30, 2002 (SE) ..... 0201615

(51) Int. Cl.
*F01L 9/02* (2006.01)

(52) U.S. Cl. ..... 123/90.12; 92/85 R; 92/85 B; 251/129.06

(58) Field of Classification Search ..... 123/90.12; 92/85 R, 85 B; 251/129.06
See application file for complete search history.

(56) References Cited

U.S. PATENT DOCUMENTS 6,067,946 A 5/2000 Bunker et al.
6,374,784 B1 * 4/2002 Tischer et al. ..... 123/90.12
6,763,790 B1 * 7/2004 Watson et al. ..... 123/90.12

* cited by examiner

*Primary Examiner*—Thomas Denion
*Assistant Examiner*—Zelalem Eshete
(74) *Attorney, Agent, or Firm*—Young & Thompson

(57) ABSTRACT

A device for the generation of pressure pulses, includes a cylinder (3), a piston that is displaceably arranged in the cylinder (3), a pressure fluid circuit with an inlet (6) into and an outlet (7) out of the cylinder (3) on one side of the piston (4), a shaft (18) connected to the piston (4), and a liquid-filled chamber (17). The shaft (18) is arranged to be displaced through said chamber (17) in connection to a displacement of the piston (4) in the cylinder (3). The device includes at least one valve member (22, 24, 29, 32) for an occasional interruption of a flow of liquid out of the chamber (17).

29 Claims, 14 Drawing Sheets

DEVICE AND A METHOD FOR THE GENERATION OF PRESSURE PULSES

TECHNICAL FIELD

The present application relates to a method and a device for the generation of pressure pulses.

The invention is applicable to all types of technical areas where pressure pulses are to be generated. In particular, it is applicable to applications by which there are high requirements on the speed by which pulses are to be generated and by which there is a desire to be able to brake the movement of a component displaced by means of such pressure pulses, or to lock the displaced component in a determined position.

Internal combustion engines is such a field, by which pressure pulses can be used for controlling and operating the movements of the valves of the combustion engine instead of using operation and control of the inlet, outlet or fuel injection valve movements by means of conventional transmission of the piston motion of the engine to the valves through a camshaft. The invention can also be used for controlling and operating a piston that is arranged for the purpose of accomplishing a variable compression ratio in an internal combustion engine cylinder.

The invention will, therefore, by way of example, but without any delimiting purpose, be described with reference to an application in which it is used for controlling and operating the inlet or outlet valves to the combustion chamber of an internal combustion engine.

THE BACKGROUND OF THE INVENTION

By pressure pulse-driven inlet, outlet or fuel injection valves to the cylinder chambers in an internal combustion engine the valve movement is generated by letting pulses of a pressure fluid, such as air, act on an actuator piston which is connected to the valve in question and which is displaceably arranged in a cylinder chamber that is particularly provided for the latter.

From its home position, in which it rests against a valve seat, the valve in question is displaced to a remote position through the action of a pressure fluid pulse against the force of a conventional valve spring. For different reasons, in order to attain variable valve times, it is often desired that the valve be lockable in its remote position, before it is permitted to return to the home position. The locking in the home position is achieved thanks to the action of the valve spring.

It is also advantageous to be able to brake the return motion of the valve to the home position for the purpose of obtaining a soft landing of the valve against the valve seat.

THE OBJECT OF THE INVENTION

It is a primary object of the present invention to provide a method and a device that make it possible to effectively lock a component, for example an inlet, outlet or fuel injection valve of a combustion engine cylinder, in a given position, preferably a remote position by the aid of a hydraulic circuit, said component having been displaced by a pressure fluid pulse.

It is a secondary object to provide a method and a device that make it possible to effectively lock a component that has been displaced by a pressure fluid pulse or a counteracting spring element, such as said valve, before the latter reaches a certain end position, for example an end position such as the home position.

It is a further object of the invention to present a method and a device that makes it possible to regain the energy that is consumed upon the braking of the movement of a component displaced by a pressure fluid pulse or by a counteracting spring element, such as an inlet, outlet or fuel injection valve.

SUMMARY OF THE INVENTION

The primary object of the invention is achieved by means of the initially defined method, which is characterized in that the liquid-filled chamber is blocked from discharge of any liquid thereof when the piston/shaft has reached a predetermined position.

The primary object of the invention is also achieved by means of a device as initially defined, characterized in that it comprises at least one valve member for the purpose of temporarily interrupting the discharge of any liquid out of said chamber.

Further features and advantages of the present invention are presented in the following, detailed description.

BRIEF DESCRIPTION OF THE DRAWINGS

Preferred embodiments of the device, according to the invention will be described in detail with reference to the annexed drawings, on which.

DETAILED DESCRIPTION OF THE INVENTION

Figure 1:
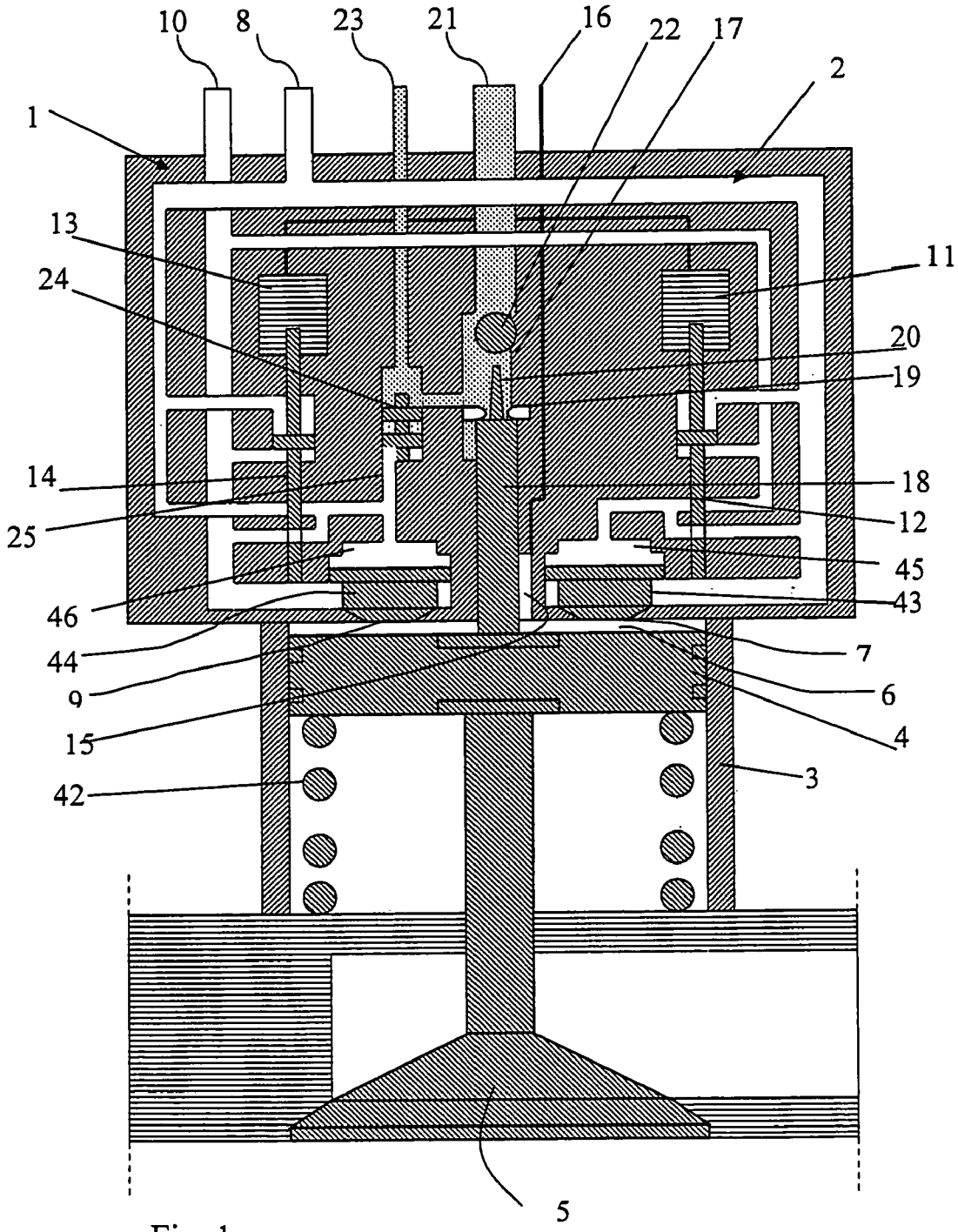
FIG. 1 is a schematic cross section of a pressure pulse generator with a hydraulic lock and brake device according to one embodiment.

FIG. 1 shows a first embodiment of a device for the generation of pressure pulses. The device is generally indicated with 1 and comprises a pressure fluid circuit 2, a cylinder 3, a piston 4 that is displaceably arranged in the cylinder 3, a valve 5 to a cylinder of a combustion engine not described in detail, said valve 5 being connected with the piston 4. Preferably, the combustion engine comprises a plurality of cylinders, each cylinder being provided with one or more devices corresponding to the inventive device 1 for operating the valves associated to the respective cylinders.

The pressure fluid circuit 2 communicates with a chamber 6 in the cylinder 3 through a first opening or inlet 7 that communicates with a pressure fluid source 8, and through a second opening or outlet 9 that communicates with a pressure fluid depression 10. Preferably, the pressure fluid is gaseous, preferably comprised by air or carbon dioxide, and the pressure fluid source 8 may be a compressor associated to the engine an equipped with an associated tank, or only a pressure tank. The pressure fluid depression 9 may be any site that has a pressure lower than the pressure generated by the pressure fluid source 8, for example the atmosphere or a conduit that leads back to the compressor. Pressure fluid controlled valve bodies 43, 44 are provided for the purpose of closing or opening the openings 7, 9 that enables the pressure fluid circuit to communicate with the chamber 6. These valve bodies 43, 44 are displaceably arranged in chambers 45, 46 and controlled by means of a variation of the pressure that exists on one side of the valve bodies in the chambers 45, 46, here the side opposite to this side on which the openings 7, 9 are located. The areas of the valve bodies on which the pressure fluid in the pressure fluid circuit acts in one direction, the closure direction, is larger than the area in the opposite direction when the valve bodies 43, 44 rests against the periphery of the openings while closing the latter.

The pressure fluid circuit 2 comprises pressure fluid control valves, in this case a first electro magnet 11 and a valve body 12 associated thereto, and a second electro magnet 13 and a valve body 14 associated thereto. Further, the device comprises a control unit (not shown), which is operatively connected with a sensor for sensing the position of a piston in the combustion engine cylinder in question, directly or indirectly through, for example, the rotational position of a crank shaft. The control unit is operatively connected with the electro magnets 11 and 13 and activates the latter based on the information from the sensor. A further sensor 15 for the registration of the position of the actuator piston 4 or the valve 5 is also operatively connected to the control unit, here by means of a conduit 16. Deactivation of the pressure fluid control valves is based on the information from the further sensor 15.

By means of a suitable arrangement of the electro magnets 11, 13 and the valve bodies 12, 14 associated thereto, and the activation thereof in accordance with a predetermined sequence, it is possible to deliver, with high precision, pressure pulses to the cylinder chamber 6 via the first opening 7 and, out of the chamber 6, via the second opening 9.

Figure 2:
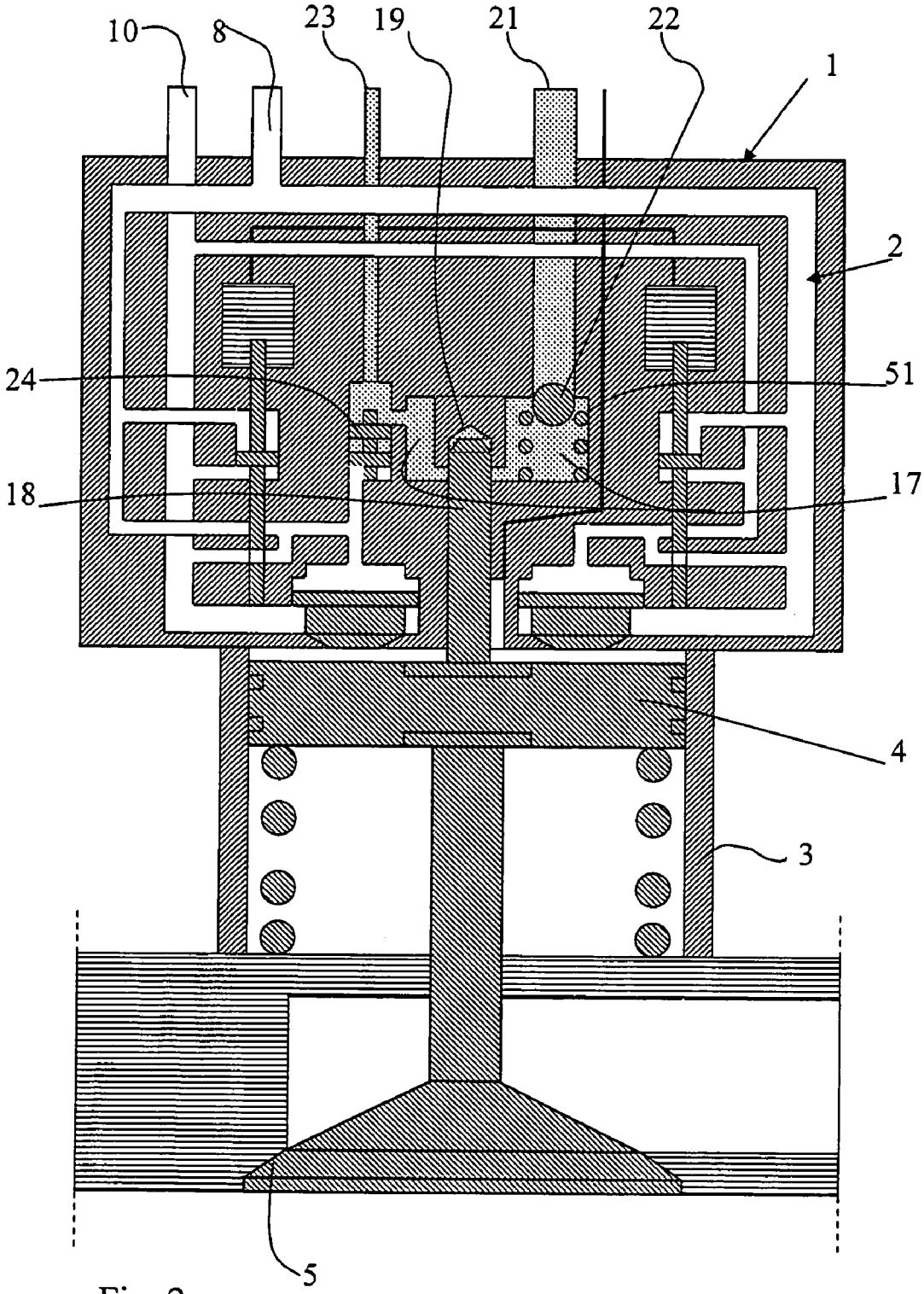
FIG. 2 is a schematic cross section of a pressure pulse generator with a hydraulic lock and brake device according to an alternative embodiment.
Figure 3:
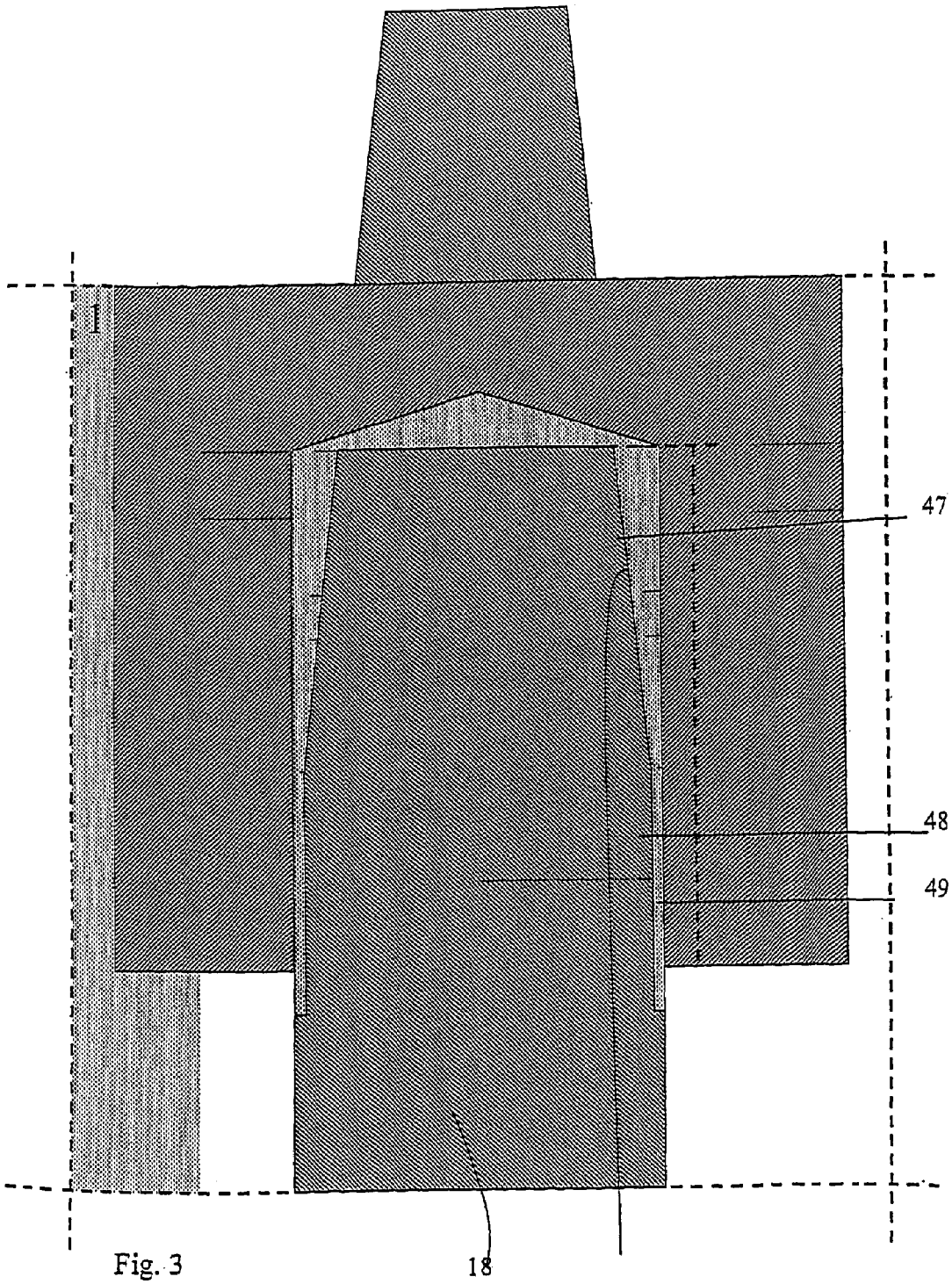
FIG. 3 is a schematic representation of an isolated part of the device according to FIG. 2.

According to the embodiments of FIGS. 1–3, the hydraulic lock and brake device has a liquid-filled chamber 17 into or out of which liquid may flow, and the actuator piston 4 may for example, as here, be in contact with the liquid in the 17 via a piston shaft 18 connected thereto during its displacement. In one of the displacement directions, here from the home position to the remote position, the piston 4, via its piston shaft 18, leaves some space for an introduction of liquid to said chamber 17. In the other displacement direction, it presses away the liquid from the chamber 17. Thereby, a braking effect is obtained. According to FIG. 1, the device comprises a constriction 19, in this case circular or annular, through which the piston shaft 18, or, more precisely, a conical end 20 thereof, passes as the piston 4 and the valve 5 get closer to one of their end positions, in this case the home position. A slot between the end 20 of the piston shaft 18 and the constriction decreases as the movement continues, resulting in an increased braking force. Thereby, the device defines a liquid brake. As an alternative of using a conical piston shaft end 20, the inner periphery of the constriction may decrease in the displacement direction in which the braking effect is to be accomplished.

The device also comprises a pressure source (not shown) for the hydraulic liquid, and a conduit 21 through which the pressure source can communicate with the chamber 17. A valve formed by a non return valve 22 is arranged to open for a flow of the hydraulic liquid from the pressure source towards the chamber 17 and to close in the opposite direction. The pressure source may be the oil pump of a combustion engine.

Further, there is a downstream conduit 23 through which liquid from the chamber 17 is supposed to be evacuated, in this case to any site that has a lower pressure than the pressure generated in the pressure source, for example the oil pan of a combustion engine. An activateable valve 24 is arranged to open/interrupt the communication between the chamber 17 and said low pressure site through the evacuation conduit 23. The valve 24 shall be open when the piston shaft 18, during the motion of the valve 4 and the valve 5 to their home position, presses away the liquid in the chamber 17. During a motion in the opposite direction, the valve 24 should be closed for the purpose of avoiding that liquid present in the evacuation conduit, and probably heated during the most previous piston stroke, is to be sucked backed into the chamber 17 and thereby contributing to an undesired increase of the temperature in the liquid and the surrounding material. The liquid pressure in the supply channel 21 is sufficient for guaranteeing that the liquid does not split upon the movement when the liquid is permitted to flow into the chamber 17 through the conduit 21.

Figure 14:
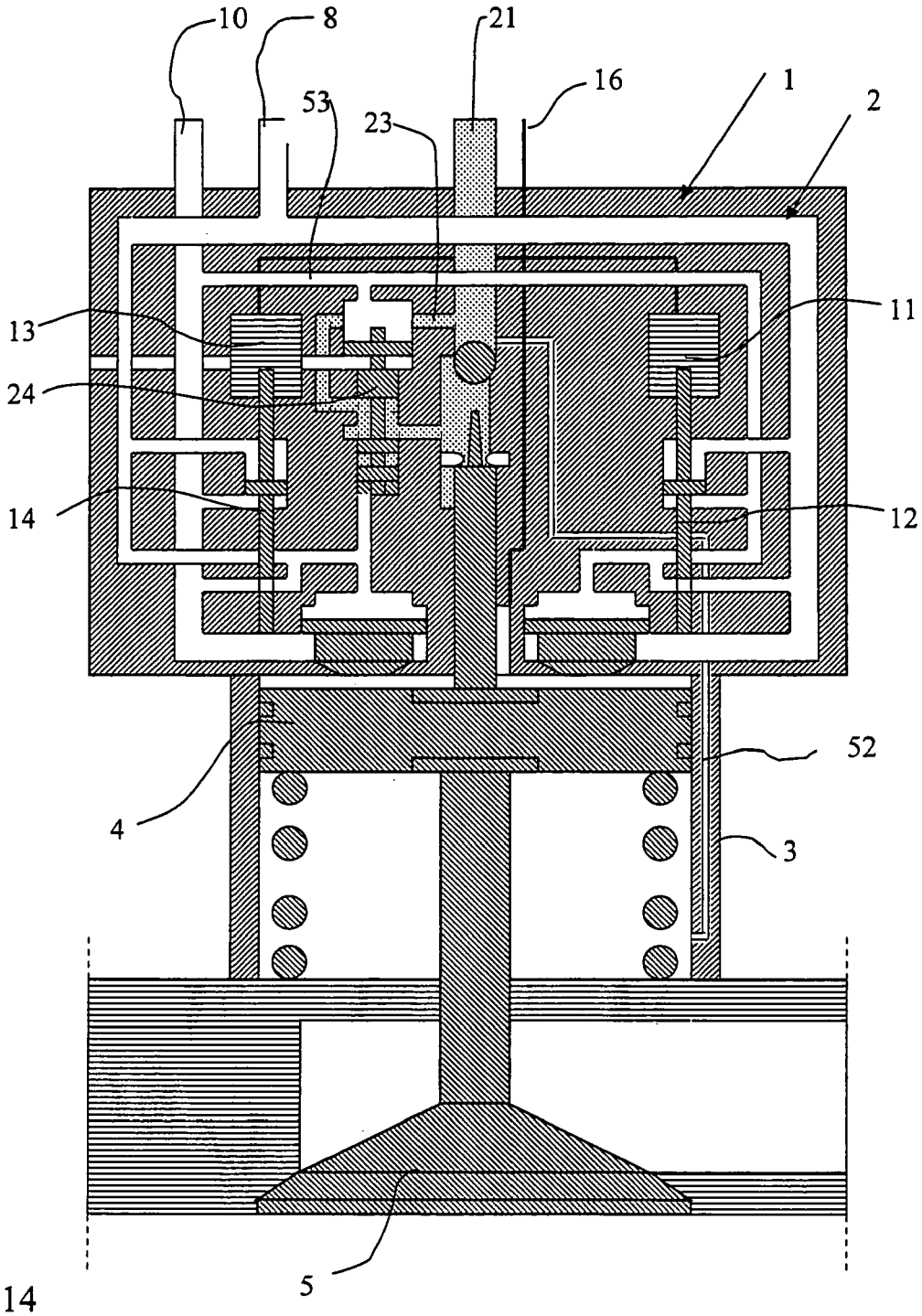
FIG. 14 is a schematic representation of an alternative embodiment of the device according to the invention.

In FIG. 14 there is shown an alternative solution to the arrangement of the evacuation conduit. Here, the evacuation conduit 23 leads back to the supply conduit 21 upstream the non return valve 22, i.e. on that side of the non return valve 22 that is most adjacent to the pressure source. Likewise to the other embodiments, the device comprises an activateable valve 24 for the opening/closure of the evacuation conduit. A reciprocating liquid column will thus be obtained between the liquid source and the chamber 17. Thereby, the amount of liquid that has to be pumped through the device is substantially used. In order to avoid any over heating of the liquid in the liquid column, and to simultaneously accomplish a lubrication of the actuator piston 4, a branch 52 leads from the liquid column, here from the supply conduit 21, into the cylinder in which the actuator piston 4 is arranged. It should be mentioned that the branch could as well depart from the evacuation conduit 23. The important thing is that the liquid that is conducted away through the branch 52 is a part of the liquid that has been heated by the brake function. It should be realized that the device, though not shown here, comprises any type of conduit for reconduction of the liquid that has been supplied to said cylinder and used for the purpose of lubrication, to a site that has a lower pressure than the pressure source, for example to the oil pan of a combustion engine. FIG. 14 further shows that the activateable evacuation valve 24 is controlled in an alternative way, which is to be described more in detail later.

A substantial aspect of the invention is that the actuator piston 4, or more precisely the valve 5, is locked in a determined position, in this case prevented from moving back towards its home position, as the outflow of the liquid from the chamber 17 is temporarily obstructed. Here, the locking takes place as the valve 24 is closed when the piston 4 and the valve 5 have reached a predetermined position, preferably an end position, here the remote position, and as the non return valve 22 closes for any outflow from the chamber 17. The locking is terminated as the valve 24 is opened for a flow of liquid in the evacuation channel. In that way, variable valve times can be achieved. The lift distance of the valve 5 from its seat is, however, primarily controlled by the choice of the time during which a pressure fluid pulse is generated through the first opening 7.

The valve 24 could comprise an electro magnet and a valve body, as has been described previously for the pressure fluid control members 11–14, but in this case it is designed as a pressure fluid operated slave valve, i.e. it is indirectly controlled through at least one on the pressure fluid control valves 11–14 in this case by the control valve formed by the second electro magnet 13 and the second valve body 14.

Via a branch 25 in the pressure fluid circuit 2, a first surface of the valve 24 is in contact with the pressure fluid and communicates either with the pressure fluid source 8 or the pressure fluid depression 10, depending on the position of said control valve 13, 14. An opposite second surface of the valve 24 is in contact with the hydraulic liquid in the evacuation conduit 23, which thereby defines a spring designed as a liquid spring. Depending on whether the valve 24 with its first surface communicates with the pressure fluid source 8 or the pressure fluid depression 10, it will be displaced to a position in which it closes and opens respectively for communication through the evacuation conduit 23. In the alternative embodiment shown in FIG. 14 however, the opposite surface communicates constantly with the pressure fluid depression in the pressure fluid circuit through a branch 53. Thereby, a gas spring is accomplished instead of a liquid spring. It should be realized that similar or reversed substitutions are possible for all spring functions shown in all embodiments of the device.

FIGS. 2 and 3 show an alternative embodiment of the design of the chamber 17 with regard to the end 20 of the piston shaft 18, for the purpose of accomplishing a suitable brake effect. The constriction is here generated as the chamber 17 has a width and shape that generally corresponds to the width and the shape of that part of the piston shaft 18 that passes through the chamber 17. The foremost, free end 20 of the shaft 18 is, however, designed as a truncated cone. During a final part of the braking movement, just before the actuator piston 4 and the valve 5 reach their home positions, the slot between the constriction and the piston shaft 18 is constant, as a substantial part 48 that follows the conical portion 47 of the end 20 of the shaft 18 has a constant cross sectional area, or at least has an outer periphery that is parallel to the inner periphery 49 of the constriction.

FIGS. 4–13 show an alternative embodiment of the liquid operated brake and locking device in a pressure pulse generator that generally corresponds to the one that has been described above.

In FIGS. 4–13, the device comprises a second cylinder chamber 26, a second piston 27 that is displaceably arranged in said chamber 26 and a spring element 28 that is arranged in the second cylinder chamber 26 and acts towards the piston 27 provided therein. The previously mentioned, first chamber 17 communicates with the second cylinder chamber 26, such that liquid is permitted to flow into this second cylinder chamber 26 on one side of the piston 27, while the spring element 28 counteracts and absorbs energy during the displacement of the piston 27 in one of the displacement directions of the first piston. In this case, the spring element 28 is formed by a mechanical spring arranged in the second cylinder chamber 26 on the opposite side of the piston 27 with regard to the side that communicates with the first chamber 17. Energy is absorbed by the spring when liquid is pressed out of the first chamber 17 in connection to a displacement of the actuator piston 4 and the valve 5 to a home position.

Also in this embodiment, in correspondence with the previously described embodiments, there is a supply conduit 21 for the communication between the first chamber 17 and a pressure fluid source, and an evacuation conduit 23 for the communication between the first chamber 17 and a site with lower pressure. Moreover there is a valve 22 designed as a non return valve, that opens for communication from the high pressure source to the first chamber 17 through the supply conduit 21 and that closes in the opposite direction. There is also an activateable valve 29 that comprises an electro magnet 30 and a valve body 31 operated thereby for the opening and closure of the evacuation conduit 23. A spring member 50, here a conduit with pressure fluid that acts against one side of the body 31 of the valve 29 and that defines a gas spring, acts in the opposite direction against the electro magnet 30 for the purpose of returning the body 13 upon deactivation of the electro magnet 30, and thereby a closure of the evacuation conduit 23.

The device also comprises an activateable valve member 32 that opens or interrupts the communication between the first chamber 17 and the second cylinder chamber 26. The term "second cylinder chamber" includes a channel that leads from the second cylinder chamber 26 to the first chamber 17. In the embodiment shown, the piston 27 comprises a piston shaft that forms the part of the piston 27 that penetrates into said channel.

The valve member 32 comprises a non return valve 33 provided for the purpose of opening for a flow of liquid from the first chamber 17 towards the second cylinder chamber 26. It also comprises a second non return valve 34 provided for the purpose of opening for a flow of liquid from the second cylinder chamber 26 to the first chamber 17.

A conduit between the first chamber 17 and the second cylinder chamber 26 comprises two channels 35, 36 that are parallel or extend beside each other. The valve member 32 comprises a valve body 38 that is displaceable through said channels and provided with at least one passage or a through hole 37. The non return valves 33 and 34 are formed by pre-loaded bodies located in each of the channels 35, 36 and on opposite sides of the valve body 38.

The valve body 38 of the valve member 32 is displaceable to a first position in which the passage or hole 37 is located in front of one of the channels 35, 36, and a second position in which the passage or hole 37 is located in front of the other channel 35, 36. By a displacement of the valve body 38, one of the non return valves 33, 34 is activated. The term "in front of" should be interpreted in a wide sense, and does not necessarily mean a centration of the passage in relation to the channel, even though this is preferred.

The valve member 32 is pressure fluid controlled and, through at least one conduit 39, connected with the pressure fluid source 8 or the pressure fluid depression 10. The valve member 32 is controlled in a way corresponding to that described previously for the first and second embodiments with reference to valve 24 in the evacuation conduit 23. Through the branch 25 in the pressure fluid circuit 2 a first surface 40 of the valve member 32 is thus in contact with the pressure fluid, and communicates either with the pressure fluid source 8 or the pressure fluid depression 10 depending on the position of said control valve 13, 14. An opposite second surface 41 of the valve member 32 is in contact with hydraulic liquid of a given pressure, here with the pressure source through the supply conduit 21. Depending on whether the valve member 32 with its first surface 40 communicates with the pressure fluid source 8 or the pressure fluid depression 10, it will be displaced to a position in which it activates one or the other of the non return valves 33, 34. The channel the non return valve 33, 34 of which is inactive is closed by the valve body 38. According to the invention, the non return valve 33 that opens in a direction towards the second cylinder chamber 26 is activated when the activator piston 4 and the valve 5 are to be displaced and are displaced to the home position, the other non return valve 34 then being inactive. A reversed condition exists when the actuator piston 4 and the non return valve 5 are to be displaced and are displaced in an opposite direction, i.e. towards the remote position.

The arrangement according to FIGS. 4–13 results in a substantial part of the energy used for the braking when the piston 4 and the valve 5 approach their home position being absorbed by the spring elements 28 and then being possible to reclaim upon redisplacement of the valve 5 in an opposite direction, instead of simply being lost as heat, which is the case of the pure liquid brake according to FIGS. 1–3.

The valve 29 associated to the evacuation conduit 23 is, in this case, arranged to open temporarily only for the purpose of letting out a residual amount of liquid at the moment or after, preferably in connection to the moment when the displacement of the piston 4/valve 5 towards the home position ceases, for the purpose of enabling a complete displacement of the piston 4/valve 5 to the home position. Belonging to the actuator piston 4/valve 5 is a valve spring that is arranged to displace the valve in a direction towards its home position. Due to energy losses in the device, without the presence of the evacuation conduit 23, the valve 5 would not be able to return completely to its home position only through the action of said valve spring 42. The valve 29 is arranged to close when the actuator piston 4/valve 5 has reached its home position, based on information from the previously mentioned sensor 15.

A particular aspect of the invention shall be mentioned. According to this aspect, the liquid comprises said fluid for the displacement of the actuator piston, and said chamber 17 is the chamber in or in connection to the cylinder 3 into which or out of which the fluid flows. In such a case, the liquid brake device itself acts as a pressure pulse generator. Accordingly, it is the liquid pulse that is supplied to the chamber 17 through a supply conduit, for example conduit 21, that communicates with a high pressure source, that brings the actuator piston into its movement. An activateable valve or arrangement of valves for the control of the length of the pressure pulses should be part of such a device. Accordingly, a pressure fluid circuit corresponding to the one described previously is not required. The valve member 32 may possibly be controlled by means of an electro magnet in order to completely avoid the need of pressure fluid. Moreover, as in all the other embodiments shown, the existing springs may be formed by gas springs, liquid springs or mechanical springs.

FIGS. 4–13 show subsequent stages in an opening/closure cycle for the actuator piston 4 and valve 5.

Figure 4:
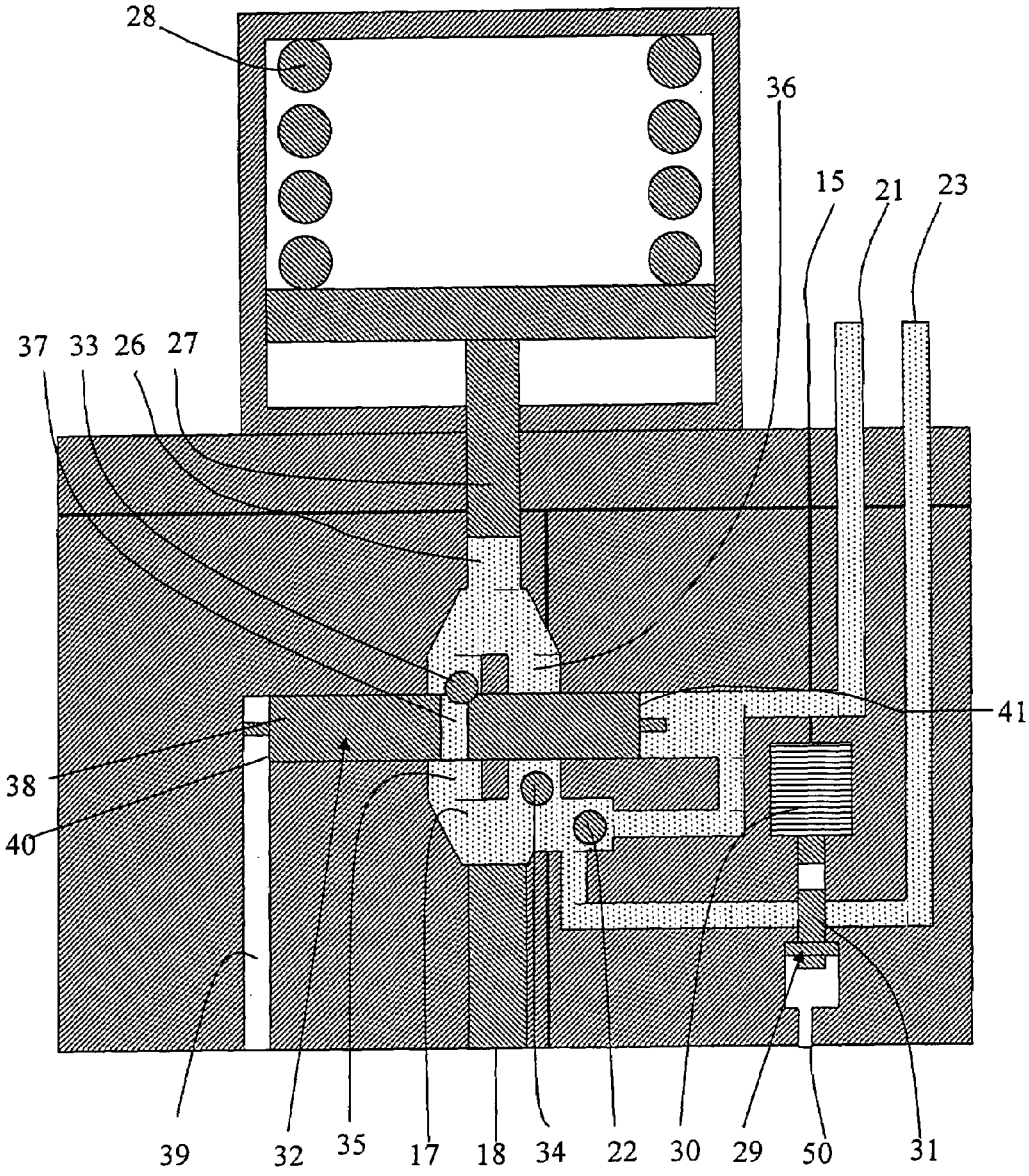
FIGS. 4–13 is a schematic representation of an alternative embodiment of the hydraulic lock and brake device according to the invention in a plurality of subsequent positions.

In FIG. 4 the engine valve 4 is in its home position. The spring element 28 is loaded and exerts a press force on the piston 27 through the piston shaft of the latter for the displacement of a liquid in a direction towards the first chamber 17. Valve member 32 is in a position in which it obstructs such a displacement.

Figure 5:
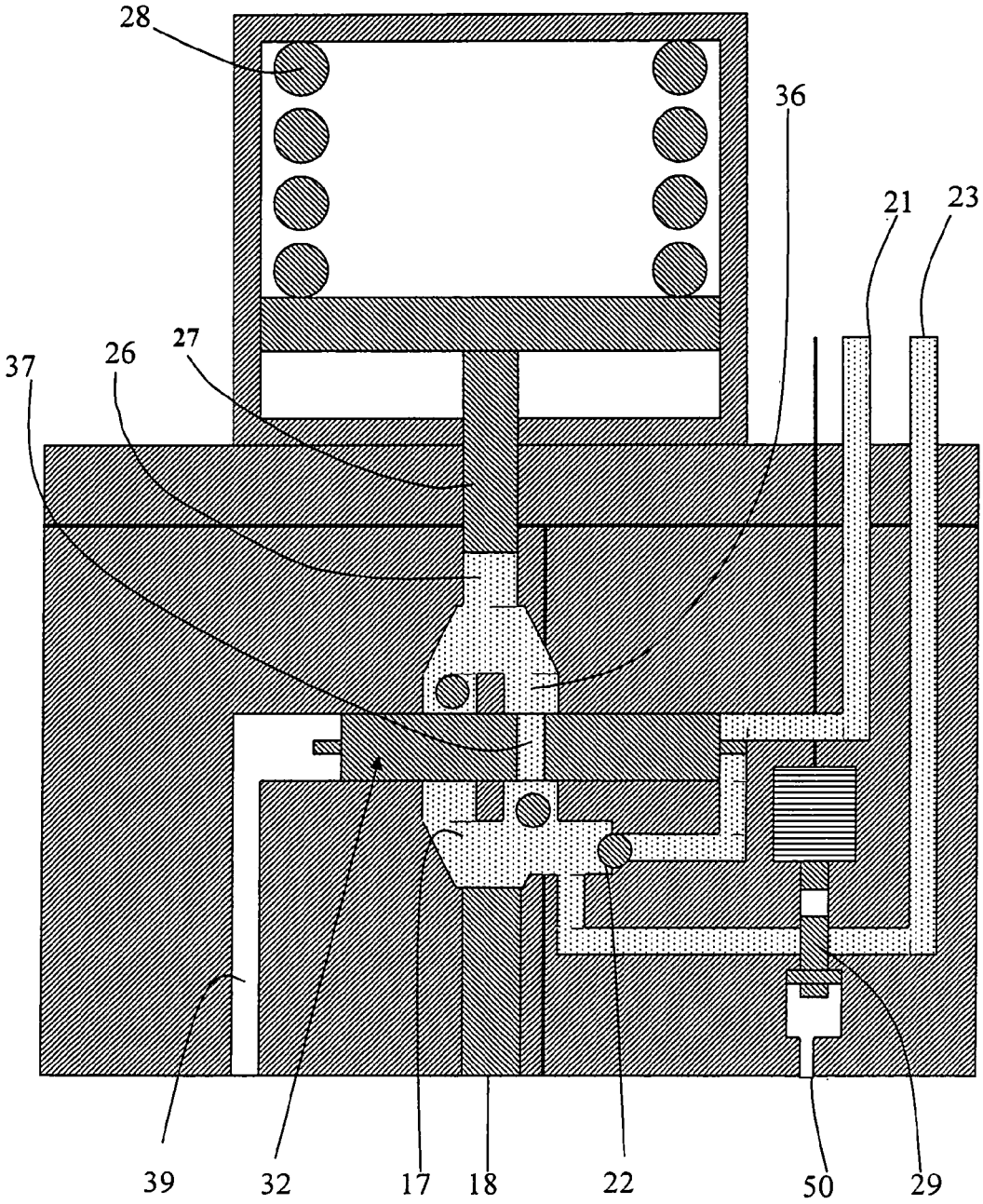

In FIG. 5 the position of valve member 32 has been shifted, such that the displacement of the piston 27 and the liquid towards the first chamber 17 is enabled.

Figure 6:
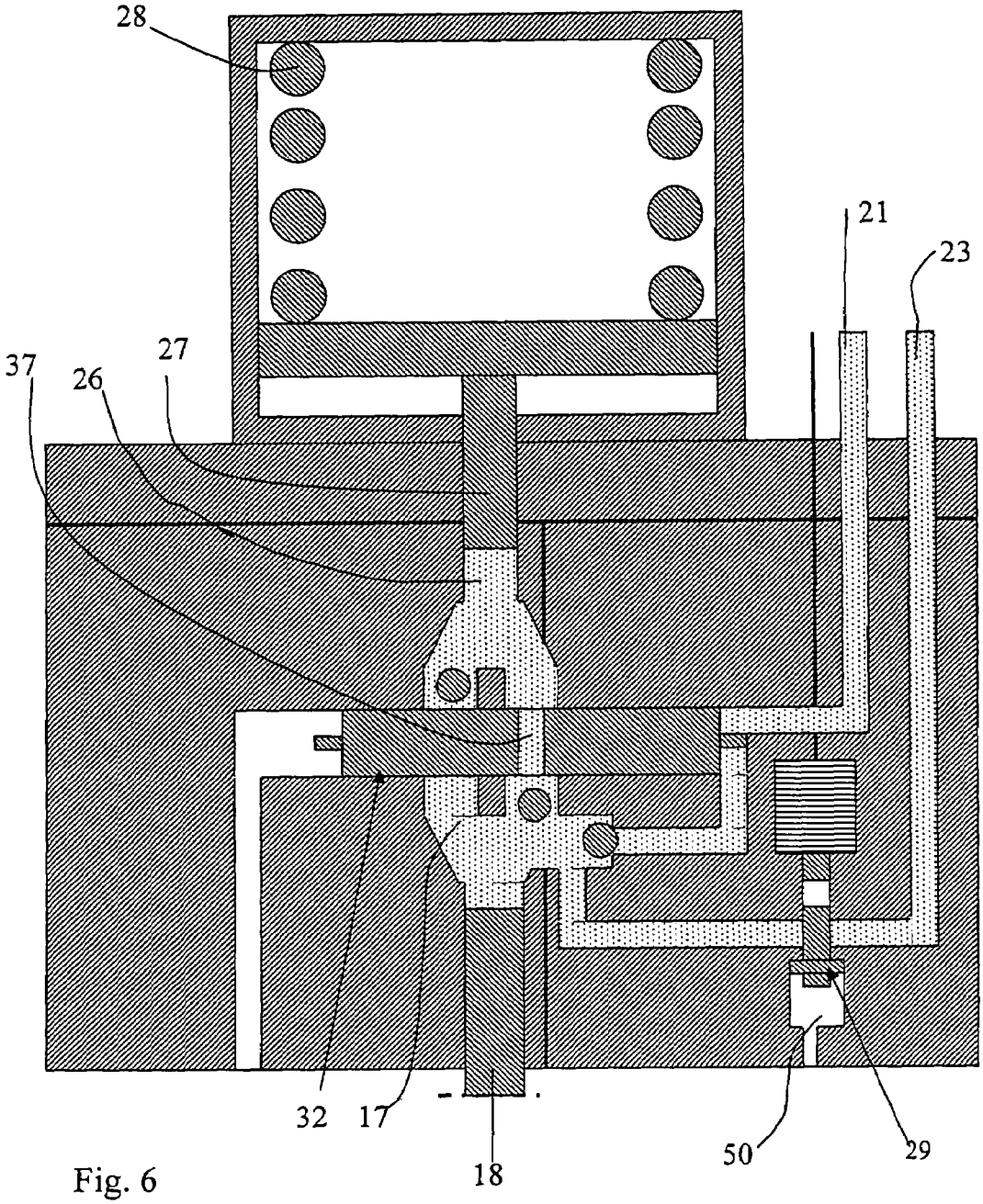

FIG. 6 shows the displacement of the piston 27, the liquid and the slightly suggested piston shaft 18 associated to the actuator piston 4.

Figure 7:
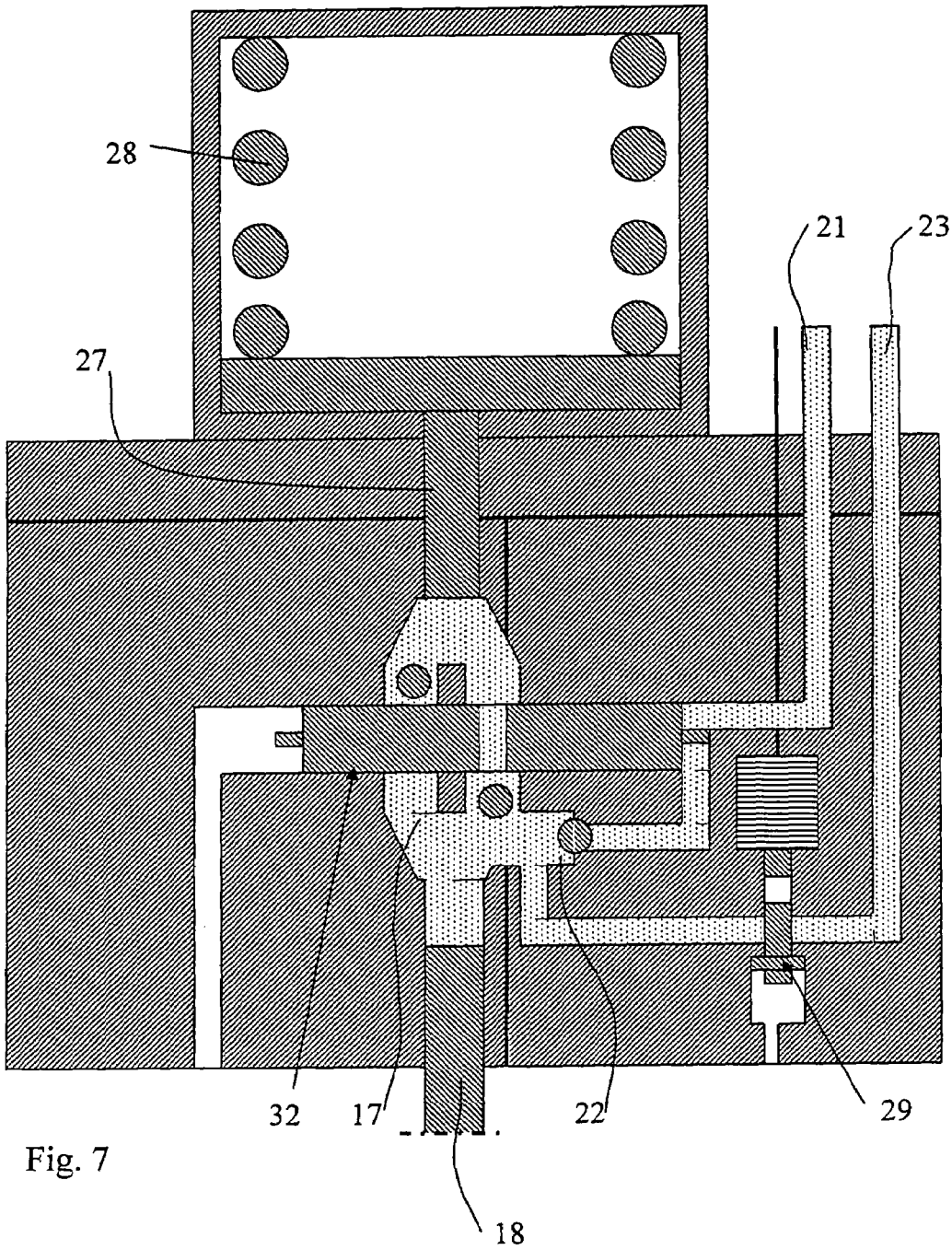

FIG. 7 shows how the displacement of the piston 27 has reached an end position.

Figure 8:
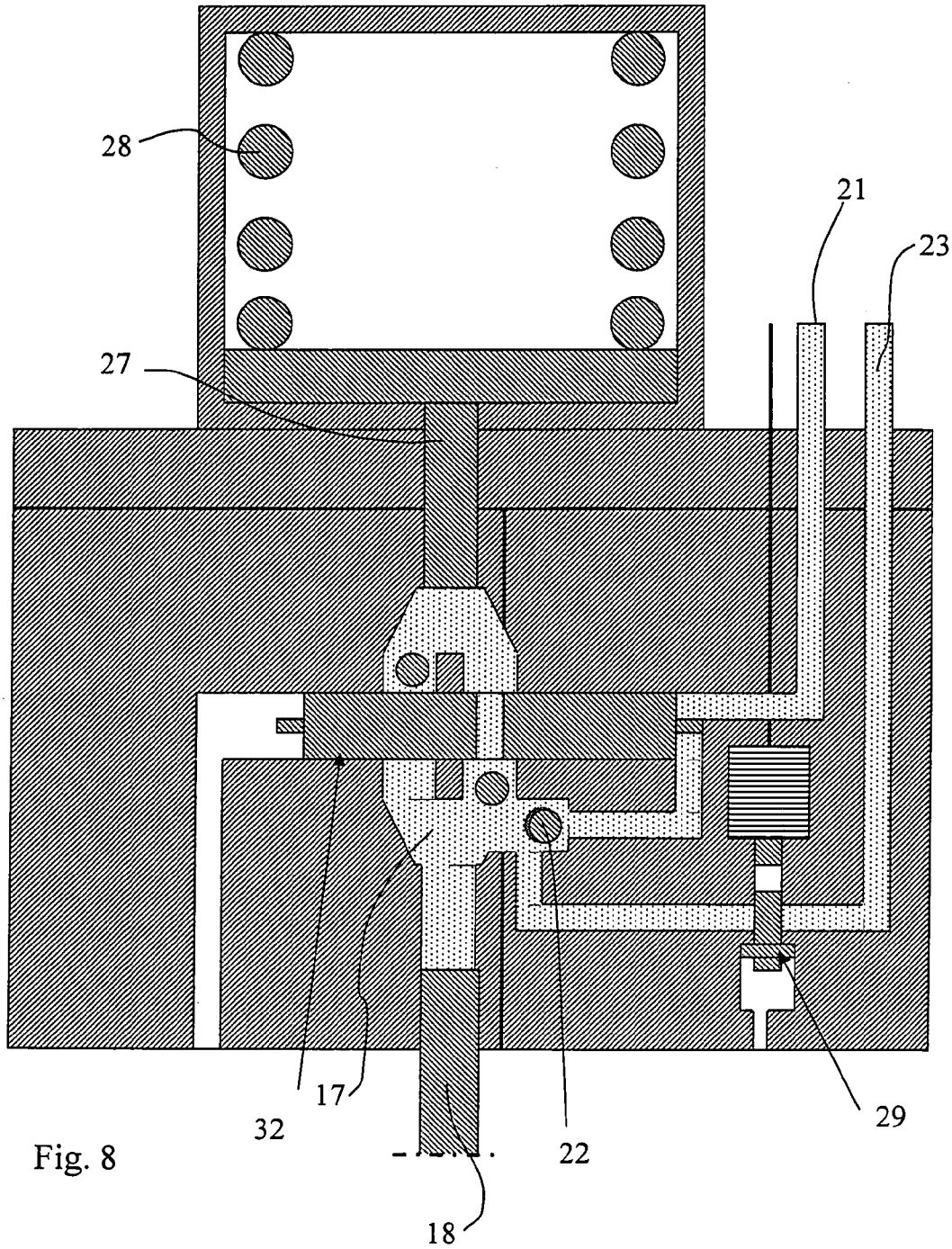

FIG. 8 shows how the displacement of the shaft of the actuator piston 4 continues a bit further, through a continued pressure fluid pulse, and how the liquid thereby is permitted to flow into the first chamber 17 through the supply conduit 21.

Figure 9:
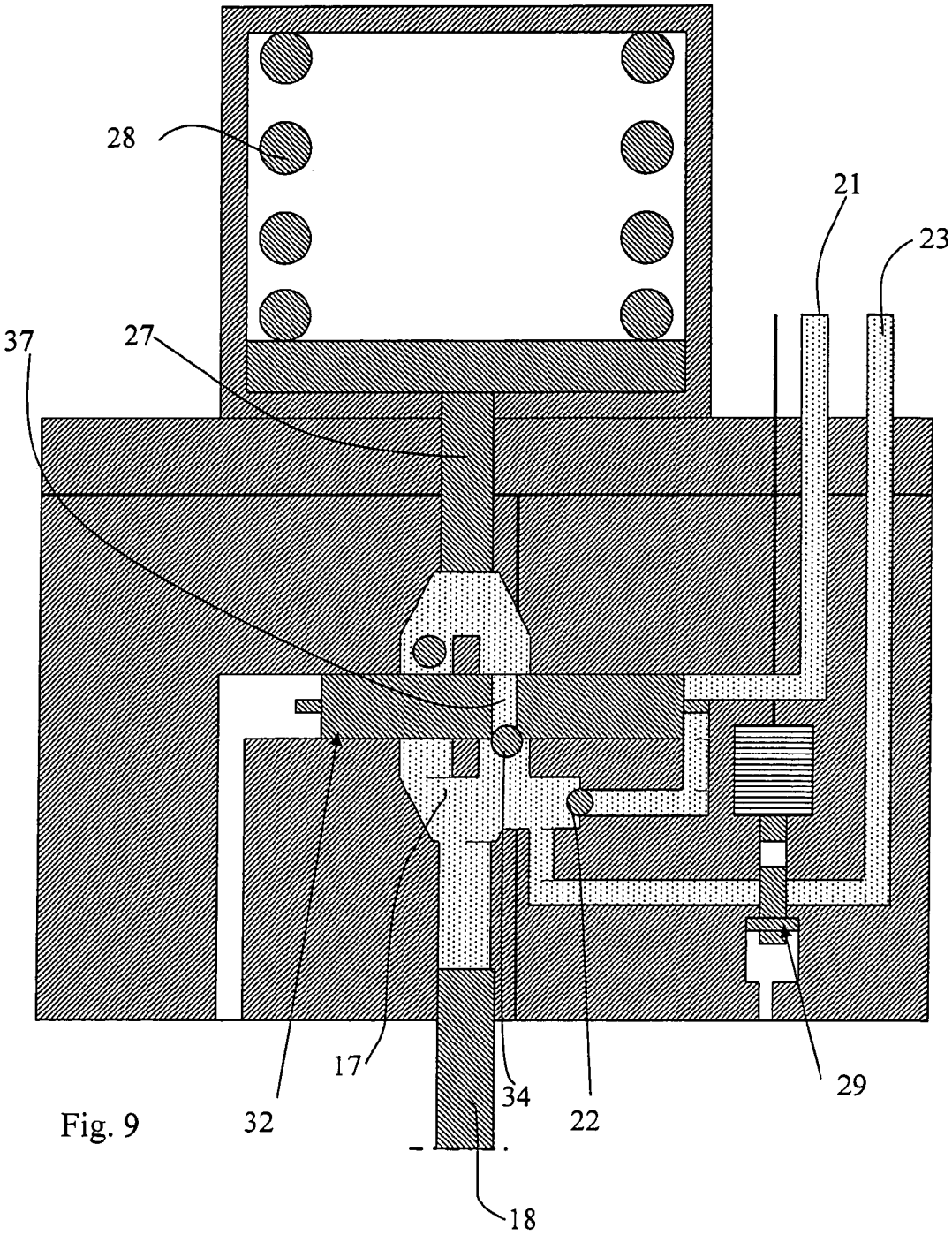

FIG. 9 shown when the piston 4 and valve 5 have reached an end position and how the valve member 32, the valve 22 and the valve 29 close for the outflow of liquid from the chamber 17, thereby locking the piston 4 and the valve 5 in an end position, here the remote position.

Figure 10:
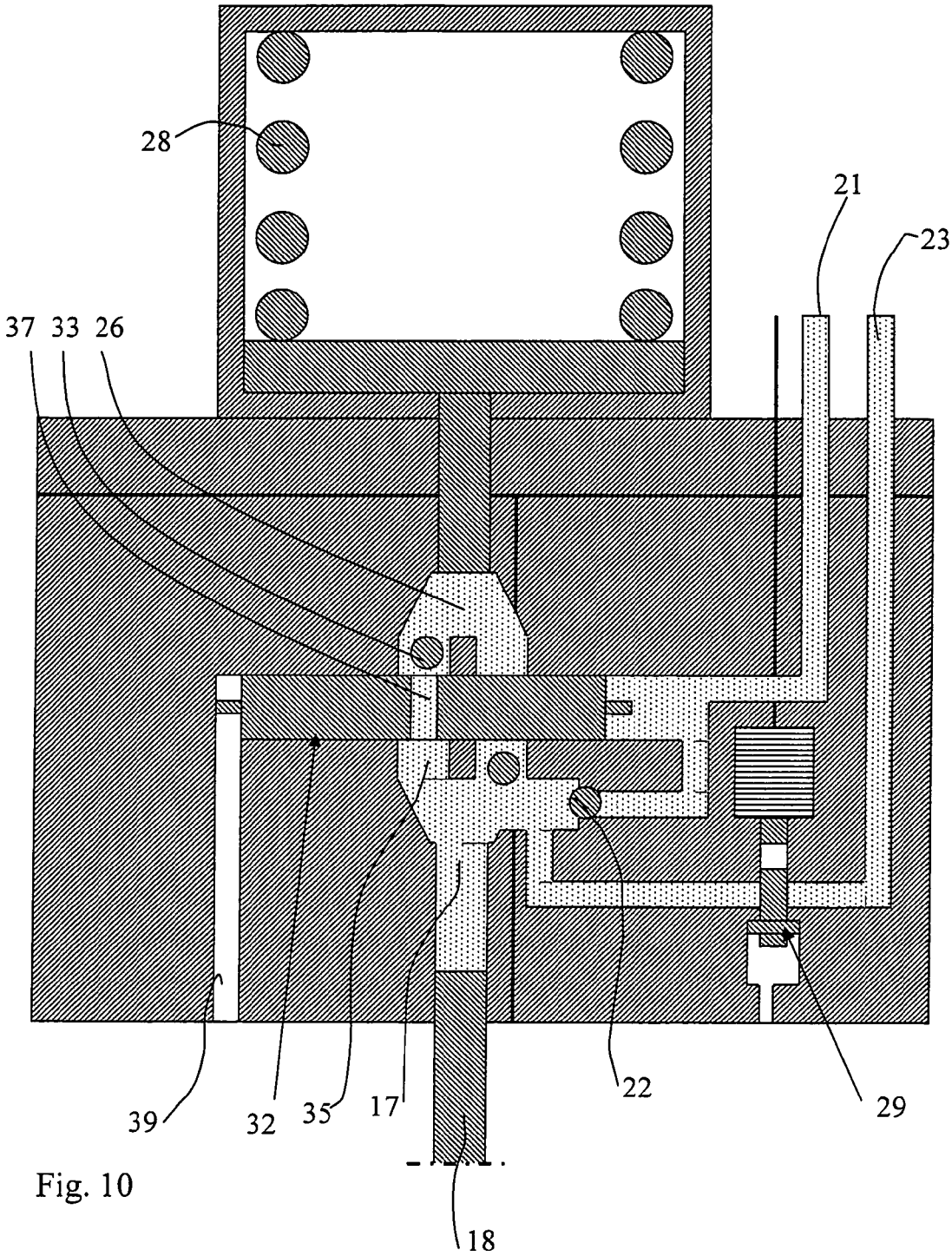

FIG. 10 shows a stage in which the position of the valve member 32 once again has been shifted, such that liquid once again can flow out of the chamber 17 towards the further piston 27, enabling displacement of the actuator piston 4 and the engine valve 5.

Figure 11:
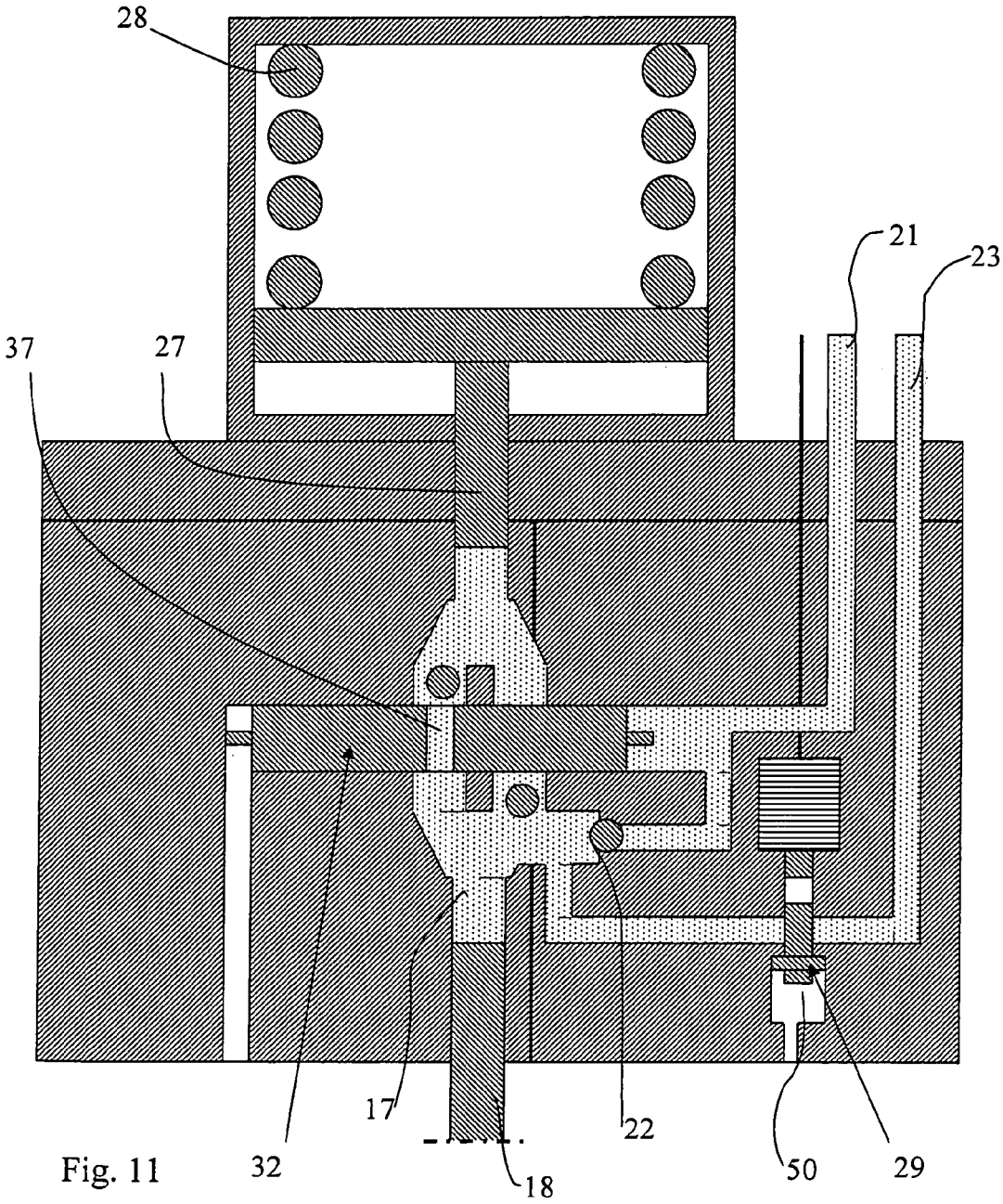

FIG. 11 shown an ongoing displacement of the actuator piston 4 towards the home position, a displacement of liquid from the first chamber 17 to the second chamber 26, and a displacement of the second piston 27.

Figure 12:
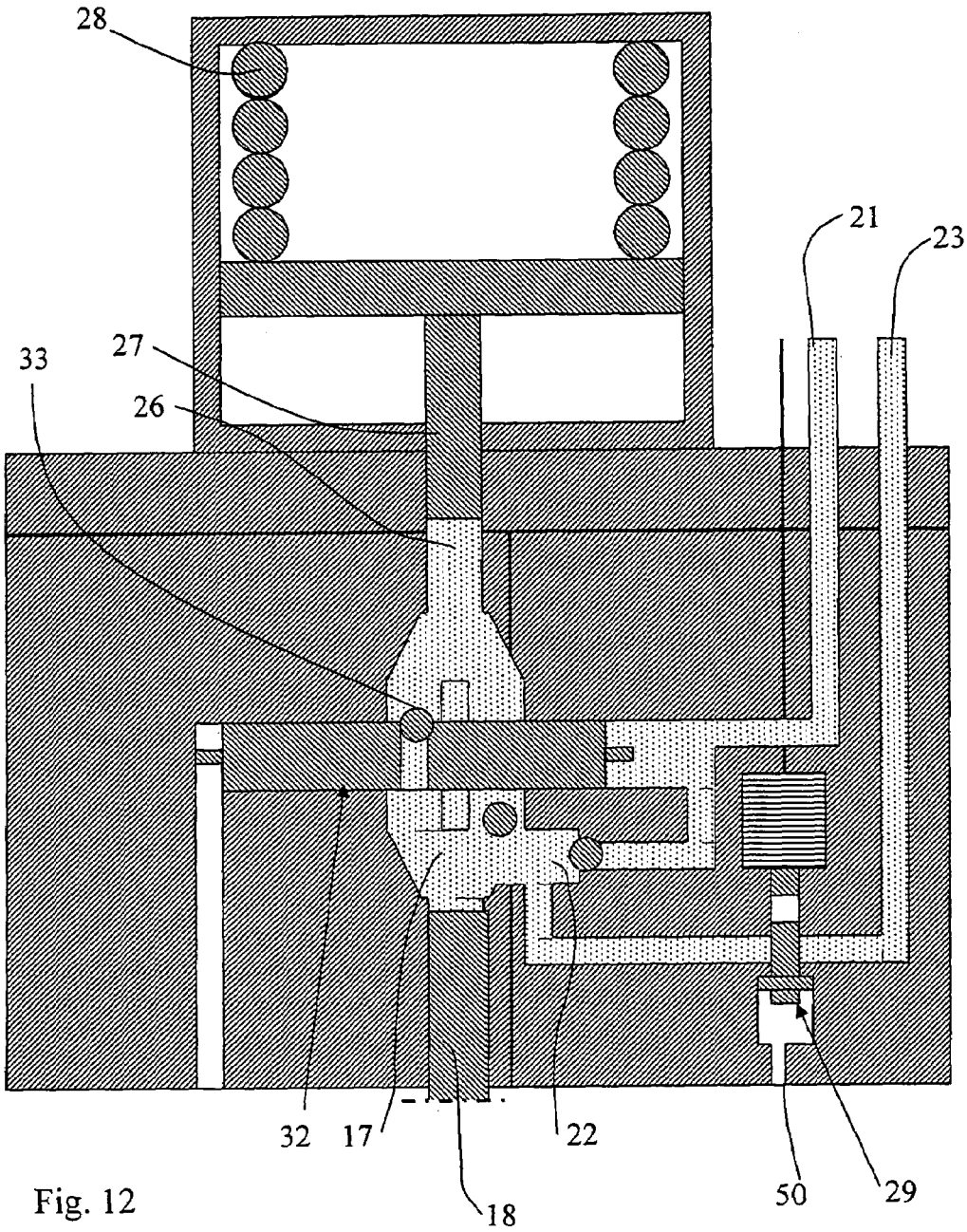

FIG. 12 shows how the displacement has reached a stage in which it tends to cease, but how a short distance is still remaining before the engine valve has reached its home position, due to energy losses.

Figure 13:
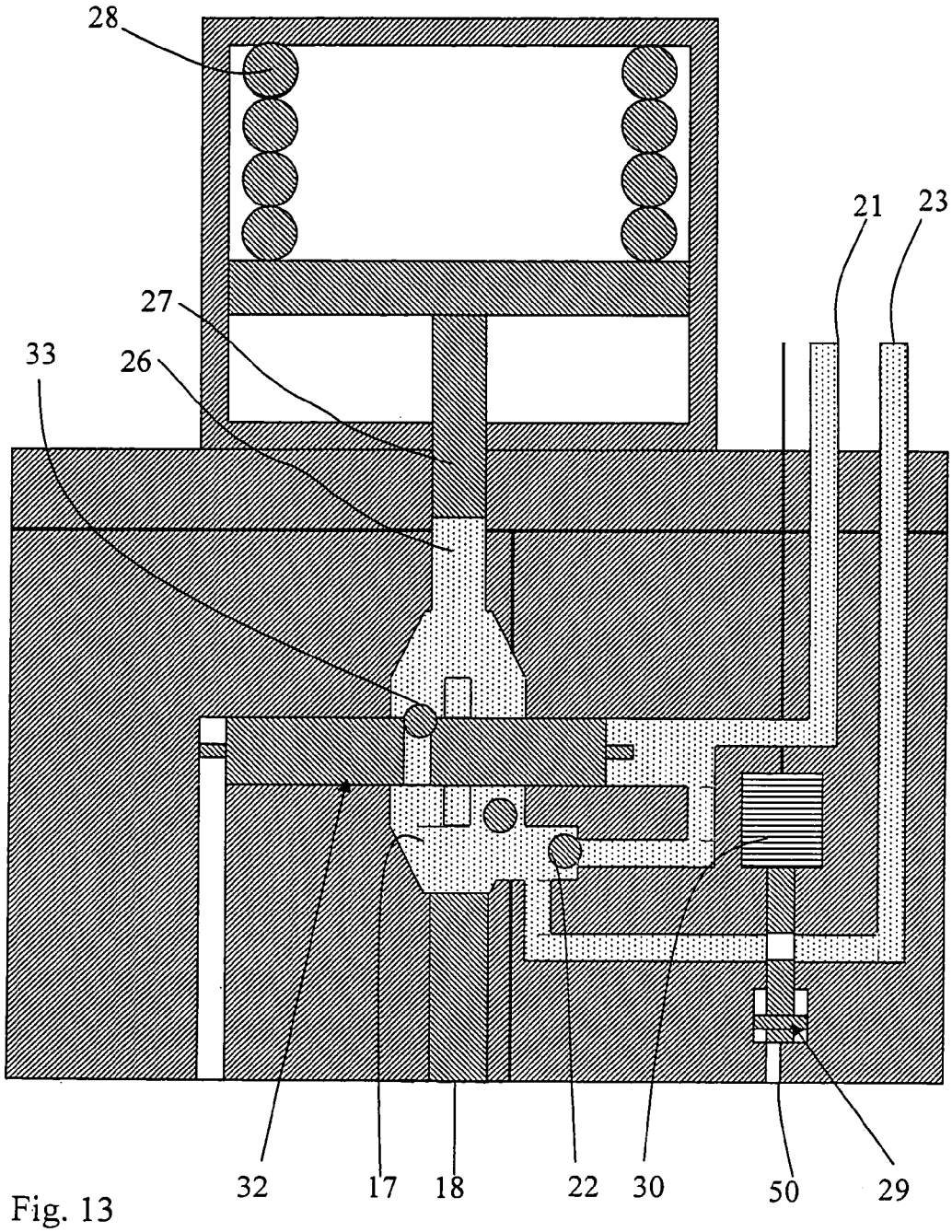

FIG. 13 shows how, upon or near to the obtaining of the position in FIG. 12, the evacuation valve 29 is open for the enabling of outflow of liquid from the first chamber 17 and an eventual displacement of the engine valve to its home position. When the engine valve has reached its home position, the valve 29 is once again closed, and the position according to FIG. 4 is obtained.

It should be realized that alternative embodiments that are still within the frame of the invention will be obvious for a person skilled in the art. The scope of protection is defined by the annexed patent claims, supported by the description and the drawings.

All non return valves are preferably, in a conventional way, provided with some kind of spring mechanism that pre-loads the individual non return valve bodies against a seat of the opening that they open and close. For a clarifying purpose, such a spring 51 has therefore been shown in FIG. 2 for the non return valve 22 in the supply conduit 21.

The invention claimed is:

1. A method for generating pressure pulses, by which a piston (4) is displaced in a first direction in a cylinder (3) as a pressurised fluid is permitted to temporarily flow into the cylinder (3) on one side of the piston (4), where after the piston (4) is displaced in a second direction while the fluid introduced therein is permitted to flow temporarily out of the cylinder (3), whereby a shaft (18) connected with the piston (4), during the displacement of the piston in one of its displacement directions, is displaced through, towards or away from the liquid in a chamber (17) that is filled with liquid and into which or out of which liquid can flow, the shaft (18) being in contact with the liquid during the displacement thereof, characterized in that the liquid-filled chamber (17) is blocked for the discharge of liquid when the piston (4)/shaft (18) has reached a predetermined position.

2. A method according to claim 1, characterized in that the liquid-filled chamber (17) is blocked for the discharge of the liquid before or at the moment when the pressurized fluid is permitted to temporarily flow into the cylinder (3).

3. A method according to claim 1, characterized in that the chamber is blocked at a first end position of the piston (4)/shaft (18).

4. A method according to claim 1, characterized in that the chamber is open for the discharge of liquid at a second dead position of the piston (4)/shaft (18).

5. A method according to claim 1, characterized in that the piston (4) is connected with an inlet or outlet valve (5) or a fuel injection valve to the combustion chamber of an internal combustion engine, or is connected with or forms a piston in a cylinder connected with the combustion chamber for the purpose of accomplishing a variable compression ratio, the displacement of the piston (4) or the valve (5) directly corresponding to the displacement of the piston (4)/shaft (18).

6. A method according to claim 1, characterized in that the fluid is a pressurized gas which is permitted to temporarily flow into the cylinder (3) for the displacement of the piston (4) in a first direction and which, a displacement of the piston (4) in an opposite direction, is evacuated from the cylinder (3).

7. A method according to claim 1, characterized in that said chamber (17) is located outside the cylinder (3), and that the shaft is permitted to pass through a liquid-filled constriction (19) in said chamber (17).

8. A method according to claim 7, characterized in that a slot between the shaft (18) and the surrounding edges of the constriction (19) is reduced as the shaft (18) passes through the constriction (19).

9. A method according to claim 1, characterized in that said chamber (17) communicates with a second cylinder chamber (26), and that liquid is permitted to flow into or out of this second cylinder chamber (26) on one side of a second piston (27) that is displaceably arranged in said second chamber, against the action of a spring element (28) that is arranged in the second cylinder chamber (26) and that acts on the piston (27) arranged therein, during the displacement of the first piston (4) or the piston shaft (18) thereof through or towards the liquid in said first chamber (17).

10. A method according to claim 9, characterized in that, when the displacement of the piston (4)/shaft (18) has ceased due to the counteracting force of the spring element (28), the liquid is blocked from flowing back from the second cylinder chamber (26) to said chamber (17).

11. A method according to claim 9, characterized in that liquid is permitted to temporarily flow out of the first chamber (17) through an evacuation conduit (23) when the displacement of the piston (4)/shaft generally has ceased due to the counteracting force of the spring element (28).

12. A method according to claim 10, characterized in that, when the liquid-filled chamber (17) is blocked from discharge, the liquid is permitted to flow out of the second cylinder chamber (26) to said chamber (17).

13. A method according to claim 9, characterized in that said liquid comprises said fluid, and that said chamber (17) is the chamber in the cylinder into which or out of which the fluid flows.

14. A device for the generation of pressure pulses, comprising:

a cylinder (3), a piston (4) that is displaceably arranged in the cylinder (3), a pressure fluid circuit with an inlet (7) to and an outlet (9) out of the cylinder (3) on one side of the piston (4), wherein a fluid in the pressure fluid circuit is gaseous, a shaft (18) connected with the piston (4), a liquid-filled chamber (17), the shaft (18) being adapted to be displaced through said chamber in connection to a displacement of the piston (4) in the cylinder (3), and at least one valve member (22, 24, 29, 32) for temporary interruption of a flow of liquid out of the chamber (17).

15. A device according to claim 14, characterized in that the piston (4) is connected with an inlet or outlet valve (5) or a fuel injection valve to the combustion chamber of an internal combustion engine, or is connected with or forms a part of a piston in a cylinder connected to the combustion chamber for the purpose of accomplishing a variable compression ratio.

16. A device according to claim 14, characterized in that the liquid-filled chamber (17) is located outside the cylinder (3), and that the shaft (18) projects into the chamber (17) sealingly with regard to the liquid.

17. A device according to claim 14, characterized in that it comprises a constriction (19) in the chamber, and that the shaft (18) is arranged to be displaced through said constriction (19).

18. A device for the generation of pressure pulses, comprising:

a cylinder;

a piston that is displaceably arranged in said cylinder;

a pressure fluid circuit with an inlet to and an outlet out of said cylinder on one side of said piston;

a shaft connected to said piston;

a liquid-filled chamber, said shaft being adapted to be displaced through said chamber in connection with a displacement of said piston in said cylinder; and at least one valve member for temporary interruption of a flow of liquid out of said chamber, wherein one of said shaft and a part of said chamber narrows in the penetration direction of the shaft, such that a spacing between the said shaft and the part of said chamber is reduced as the shaft is moved through the part of said chamber in one of its moving directions.

19. A device according to claim 14, characterized in that it comprises a second cylinder chamber (26), a piston (27) which is displaceably arranged in said second cylinder chamber, and a spring element (28) that is arranged in the second cylinder chamber (26) and that acts in the piston (27) arranged therein, and in that said first chamber (17) communicates with the second cylinder chamber (16), such that liquid is permitted to flow into this second cylinder chamber (26) on one side of the piston (27) while the spring element (28) counteracts and absorbs energy during the displacement of the piston (27) in one of the displacement directions thereof.

20. A device according to claim 19, characterized in that it comprises a valve member (32) that is arranged to open for or interrupt a communication between said chamber (17) and the second cylinder chamber (26).

21. A device according to claim 20, characterized in that the valve member comprises an activateable non-return valve (33), adapted to open for the flow of liquid in a direction from said chamber (17) to the second cylinder chamber (26).

22. A device according to claim 19, characterized in that the valve member comprises a second activateable non-return valve (34), adapted to open for a flow of liquid from the second cylinder chamber (26) to said chamber (17).

23. A device according to claim 19, characterized in that a conduit between said chamber (17) and the second cylinder chamber (26) comprises two channels (35, 36) that are parallel or extends beside each other, and in that the valve member (32) comprises a valve body (38) which is displaceable through said channels and which is provided with at least one through passage or through hole (37).

24. A device according to claim 23, characterized in that the valve body (38) of the valve member (32) is displaceable to a first position, in which said passage or hole (37) is located in front of one of the channels (35, 36), and a second position, in which said passage or hole (37) is located in front of the other channel (36, 35).

25. A device according to claim 20, characterized in that the valve member (32) is directly or indirectly controlled, via a pressure fluid circuit, by an electro magnet (12).

26. A device according to claim 14, characterized in that said chamber (17) communicates with a pressure source for the liquid via an inlet or a conduit (21) to the chamber.

27. A device according to claim 26, characterized in that it comprises a valve member (22) for interrupting the communication in a direction from the chamber (17) to the pressure source.

28. A device according to claim 14, characterized in that it comprises an activateable valve member (29) that can be opened and closed for brief evacuation of liquid from said chamber (17) via an evacuation outlet or a conduit (23) from said chamber (17).

29. A device according to claim 19, characterized in that the liquid comprises said fluid, and that said chamber (17) is the chamber in the cylinder (3) that the fluid flows into or out of.

* * * * *